US010137714B2

(12) United States Patent
Hata

(10) Patent No.: US 10,137,714 B2
(45) Date of Patent: Nov. 27, 2018

(54) PRINTER AND PRINTING PROGRAM

(71) Applicant: CASIO COMPUTER CO., LTD., Tokyo (JP)

(72) Inventor: Ryosuke Hata, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/472,122

(22) Filed: Mar. 28, 2017

(65) Prior Publication Data

US 2017/0282618 A1 Oct. 5, 2017

(30) Foreign Application Priority Data

Mar. 31, 2016 (JP) ..... 2016-072358
Mar. 17, 2017 (JP) ..... 2017-052241

(51) Int. Cl.

*B41J 2/045* (2006.01)
*B41J 29/38* (2006.01)
*B41J 2/355* (2006.01)
*B41M 5/00* (2006.01)

(52) U.S. Cl.

CPC ..... *B41J 29/38* (2013.01); *B41J 2/04573* (2013.01); *B41J 2/355* (2013.01); *B41J 2202/34* (2013.01); *B41M 5/0052* (2013.01)

(58) Field of Classification Search

CPC ..... B41J 29/38; B41J 2/04573; B41J 2/355; B41J 2202/34; B41M 5/0052

See application file for complete search history.

(56) References Cited

U.S. PATENT DOCUMENTS

2002/0113857 A1* 8/2002 Jimbo ..... B41J 2/3551 347/182

FOREIGN PATENT DOCUMENTS

| | | | |
|---|---|---|---|
| JP | H6-143648 | A | 5/1994 |
| JP | H11-105328 | A | 4/1999 |
| JP | H11-277783 | A | 10/1999 |

* cited by examiner

*Primary Examiner* — Yaovi M Ameh

(74) *Attorney, Agent, or Firm* — Chen Yoshimura LLP

(57) ABSTRACT

A printer includes a printing head that includes a plurality of heating elements arranged in a first direction and a processor, wherein printing data representing an image to be printed on a printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, and wherein, for each of the line data, the processor obtains distribution information of the printing dots in the line data, and sets an energizing time, during which the selected heating elements are energized continuously, or intermittently by pulses, to print the corresponding printing dots, in accordance with the distribution information of the printing dots in the line data.

16 Claims, 6 Drawing Sheets

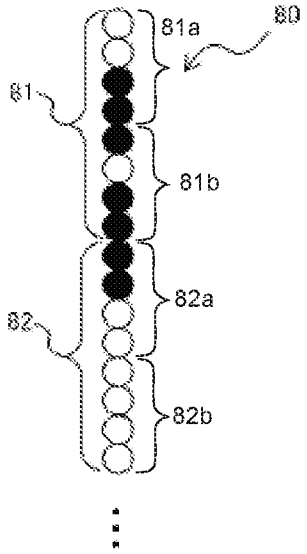
FIG. 8
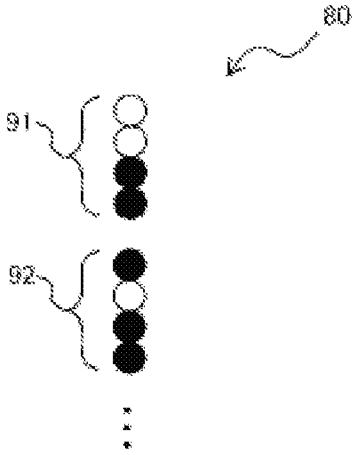
FIG. 9
| Variable | Coefficient |
|---|---|
| zero | −83～−67 |
| one | 68～84 |
| two | 94～116 |
| three | 355～435 |
| four | 418～512 |
| near | 135～165 |
FIG. 10

PRINTER AND PRINTING PROGRAM

BACKGROUND OF THE INVENTION

1. Field of the Invention

The present invention relates to a printer that creates labels by printing print data onto a tape and then cutting the tape, and to a printing program executed by such a printer.

2. Description of the Related Art

In one type of conventional printer, heating elements arranged on a thermal head generate heat in order to print printing data that includes any characters, patterns, or the like onto a roll of elongated tape, and this tape is then cut to make it possible to easily create labels. This type of printer utilizes a printing scheme in which the elongated tape is passed together with an ink ribbon between the thermal head and a platen roller, and the portion of the ink ribbon that is heated by the thermal head is thermally transferred to the surface of the elongated tape as a printed image that includes characters, patterns, or the like. In this type of printer, the thermal head generates heat in accordance with the line data representing each single line in the printing data while ink ribbon and the tape are fed through one line at a time, thereby sequentially printing and outputting the printing data one line at a time.

This type of thermal transfer printer prints by heating the heating elements in the thermal head, and therefore when a given heating element is heated, that heat also gets transmitted to the adjacent heating elements. In other words, the temperature of the adjacent heating elements becomes higher than the target temperature, which can cause additional ink to melt and thereby result in the printed characters and the like becoming smudged or blurry. In other words, the effects of the heat generated by nearby heating elements can result in a decrease in printing quality.

In one technology for solving this problem, the temperature near the thermal head is measured using a thermistor arranged near the thermal head and then fed back to the printer in order to change the energizing time for the thermal head while printing.

In another technology, a control process that uses the ratio of printing data relative to the effective printing dot count of the thermal head (a black dot ratio) to divide up the printing data and change the printing speed is implemented.

Japanese Patent Application Laid-Open Publication No. H6-143648, for example, discloses a thermal transfer recorder that detects the number of heating elements to which pulses can be applied and then controls the number of pulses applied to those heating elements according to the detection results.

However, due to the time lag between changes in the temperature near the thermal head and changes in the temperature of the thermal head itself, it is not possible to print using a suitable energizing time, nor is it possible to maintain satisfactory printing quality.

Moreover, even when the printing speed is changed according to the black dot ratio, variations in printing quality still tend to occur due to differences in the distribution of black dot data.

The present invention was made in light of the foregoing and aims to provide a printer that makes it possible to print with high quality, as well as a printing program to be executed by that printer.

Accordingly, the present invention is directed to a scheme that substantially obviates one or more of the problems due to limitations and disadvantages of the related art.

SUMMARY OF THE INVENTION

The present invention uses the following configuration to solve the abovementioned problems.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a printer, including: a printing head that includes a plurality of heating elements arranged in a first direction; and a processor, wherein printing data representing an image to be printed on a printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, wherein, for each of the line data, the processor selectively activates the heating elements that correspond to the printing dots in the line data so as to make the selected heating elements generate heat and print the corresponding printing dots in the line data on the printing medium, and wherein, for each of the line data, the processor obtains distribution information of the printing dots in the line data, and sets an energizing time, during which the selected heating elements are energized continuously, or intermittently by pulses, to print the corresponding printing dots, in accordance with the distribution information of the printing dots in the line data.

In another aspect, the present disclosure provides a method to be executed by a printer including a processor and a printing head that includes a plurality of heating elements arranged in a first direction, wherein printing data representing an image to be printed on a printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, the method including: by way of the processor, for each of the line data, selectively activating the heating elements that correspond to the printing dots in the line data so as to make the selected heating elements generate heat and print the corresponding printing dots in the line data on the printing medium; and by way of the processor, for each of the line data, obtaining distribution information of the printing dots in the line data, and setting an energizing time during which the selected heating elements are energized continuously, or intermittently by pulses, to print the corresponding printing dots, in accordance with the distribution information of the printing dots in the line data.

In another aspect, the present disclosure provides a non-transitory computer-readable storage medium having stored therein a printing program executable by a printer that includes a processor and a printing head having a plurality of heating elements arranged in a first direction, wherein printing data representing an image to be printed on the printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, the printing program causing the processor in the printer to perform the following: for each of the line data, selectively activating the heating elements that correspond to the printing dots in the line data so as to make the selected heating elements generate heat and print the corresponding printing dots in the line data on the printing medium; and for each of the line data, obtaining distribution information of the printing dots in the line data; and setting an energizing time during which the selected heating elements are energized continuously, or intermittently by pulses, to print the corresponding printing dots, in accordance with the distribution information of the printing dots in the line data.

The present invention makes it possible to print with high quality by making the heating elements arranged on the thermal head generate heat in a suitable manner.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 8 illustrates an example of the structure of a line data showing a portion having two line segments that each have further divided sub-segments, as divided by the first counting unit 44.

FIG. 9 illustrates an example of the structure of segments in the line data, as divided by the second counting unit 45.

FIG. 10 illustrates the relationship between variables and coefficients.

DETAILED DESCRIPTION OF EMBODIMENTS

Next, an embodiment of the present invention will be described in detail with reference to figures.

Figure 1:
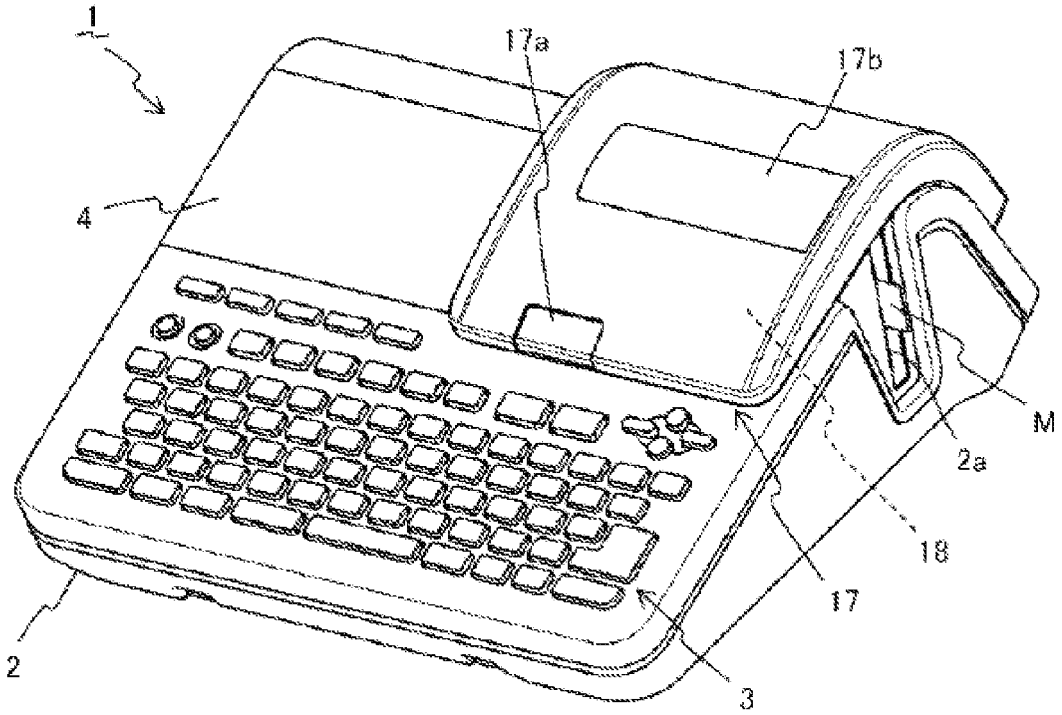
FIG. 1 is a plan view of a printer according to an embodiment.

FIG. 1 is a plan view of a printer according to the embodiment.

As illustrated in FIG. 1, a printer 1 includes a case 2, an input unit 3, a display unit 4, an opening/closing lid 17, and a cassette compartment 18. Alternatively, the input unit 3 and the display unit 4 may be included in an external device (such as a computer; not illustrated in the figure), and the printer 1 may receive printing data that represents the desired image to be printed from that external device.

The input unit 3, the display unit 4, and the opening/closing lid 17 are arranged on the top surface of the case 2. An outlet 2*a* for a printing medium M is formed in the right side face of the case 2. The printing medium M is an elongated tape that is rolled into a roll in advance, for example.

The input unit 3 includes any or all of the following: input keys for inputting a desired printing image that includes characters, patterns, or the like; a print key for issuing an instruction to start printing; cursor keys for moving around a cursor on a display screen of the display unit 4; and various control keys for configuring the printing mode and executing various configuration processes; and the like. The above-mentioned input keys include character input keys for inputting character data.

The display unit 4 is a liquid crystal display panel, for example, and displays images that contain the characters corresponding to the input from the input unit 3, selection menus for selecting various settings, messages related to various processes, and the like.

The opening/closing lid 17 is arranged on top of the cassette compartment 18 in order to make the cassette compartment 18 openable/closable. The opening/closing lid 17 can be opened by pressing a button 17*a*, for example.

Moreover, a window 17*b* is formed in the opening/closing lid 17 in order to make it possible to see whether a cassette 20 (see FIG. 2) is currently housed in the cassette compartment 18 even when the opening/closing lid 17 is closed.

Figure 2:
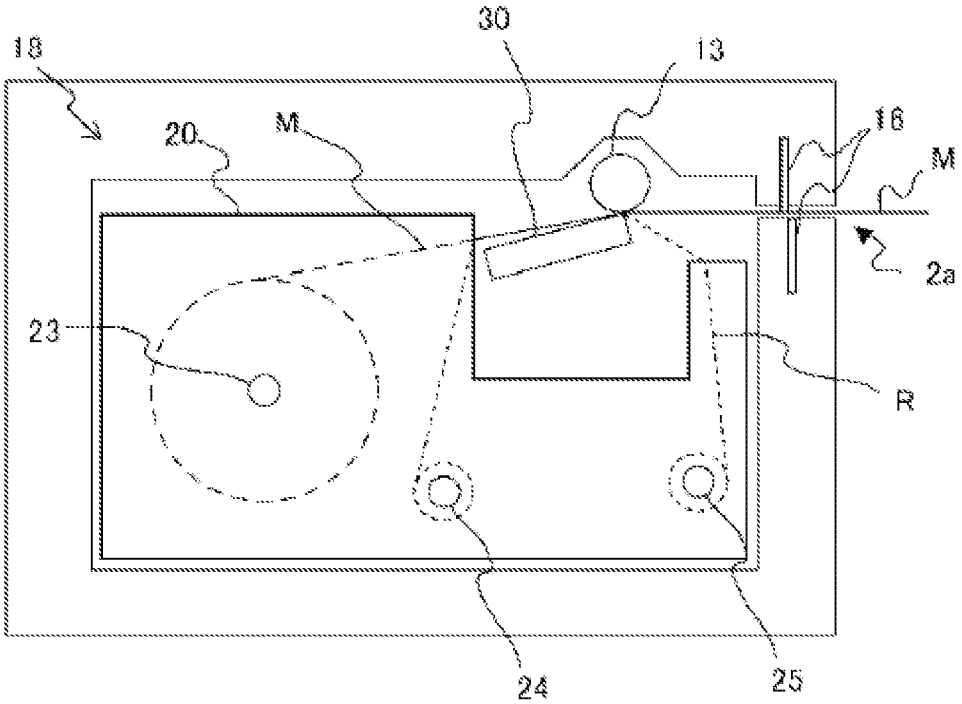
FIG. 2 is a cross-sectional view of the printer according to the embodiment.

FIG. 2 is a cross-sectional view of the printer according to the embodiment.

FIG. 2 illustrates the structure near the cassette compartment 18. The cassette 20 houses the printing medium M and an ink ribbon R and is interchangeably housed within the cassette compartment 18. The printing medium M is rolled around a tape core 23 inside of the cassette 20 and is conveyed together with the thermal transfer ink ribbon R to a thermal head 30 of the printer 1 by a roller conveyor 13. The ink ribbon R is rolled around a ribbon supply core 24 inside of the cassette 20. After the thermal head 30 transfers the ink onto the printing medium M, the used ink ribbon R gets wound around a ribbon winding core 25. Once the printing process is complete, the printing medium M that has traveled past the thermal head 30 is cut by a cutting mechanism 16 and fed out of the outlet 2*a*.

Figure 3:
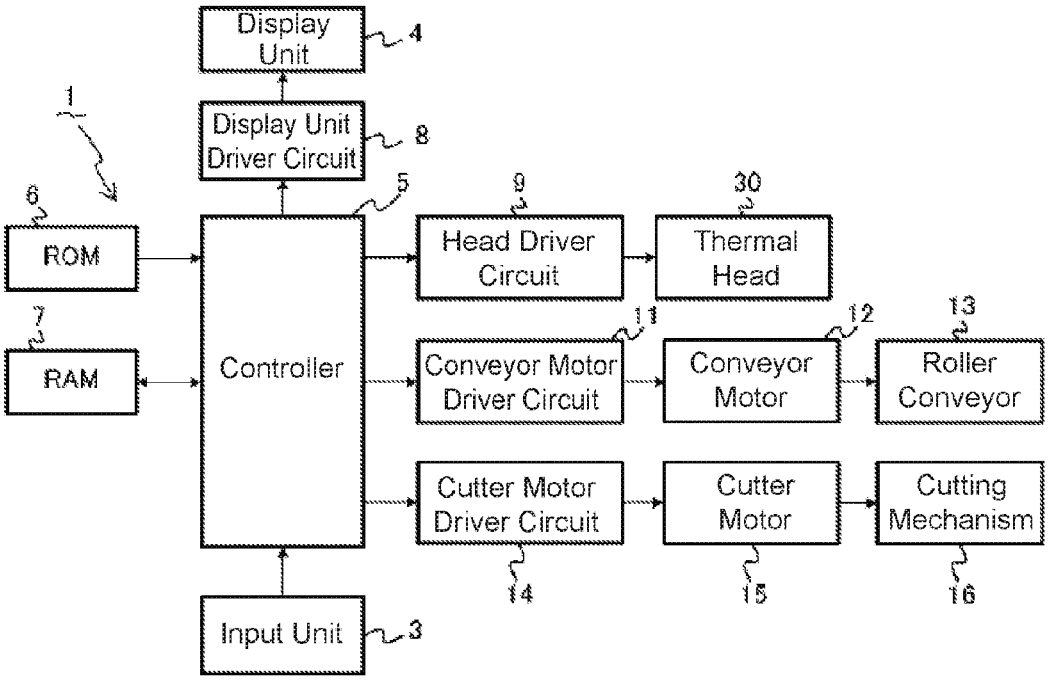
FIG. 3 is a hardware block diagram of the printer according to the embodiment.

FIG. 3 is a hardware block diagram of the printer according to the embodiment.

As illustrated in FIG. 3, the printer 1 includes, in addition to the input unit 3 and the display unit 4 described above, a processor 5, a read-only memory (ROM) 6, a random-access memory (RAM) 7, a display unit driver circuit 8, a head driver circuit 9, the thermal head 30 (an example of a printing head), a conveyor motor driver circuit 11, a conveyor motor 12, the roller conveyor 13, a cutter motor driver circuit 14, a cutter motor 15, and the cutting mechanism 16.

Moreover, in the printer 1, after the desired printing image is printed onto the printing medium M illustrated in FIG. 1 in accordance with the printing data, the printing medium M is cut to produce a printed material onto which the desired printing image has been printed. For example, after the desired printing image that includes any characters, patterns, or the like is printed, the elongated tape is cut to produce a strip of tape (a label). Furthermore, the elongated tape includes a base material that has an adhesive layer and a release paper that covers the adhesive layer and is thus peelably attached to the base material, for example, and this elongated tape is conveyed together with the thermal transfer ink ribbon R to the thermal head 30. However, the printer 1 may also be a device that prints on another type of printing medium such as sheets of paper that are not rolled up and are instead simply housed as a stack of sheets.

The processor 5 is a central processing unit (CPU), for example, and automatically executes system programs stored in the ROM 6 in advance, control programs that are stored on a memory card, control programs that are loaded from an external device, and the like in accordance with key operation signals from the input unit 3 in order to control the operation of the circuits, while using the RAM 7 as working memory.

The controller 5 is connected to the input unit 3, the ROM 6, the RAM 7, the display unit driver circuit 8 that drives the display unit 4, the head driver circuit 9 that drives the thermal head 30, the conveyor motor driver circuit 11 that drives the conveyor motor 12, and the cutter motor driver circuit 14 that drives the cutter motor 15. Moreover, the conveyor motor 12 drives the roller conveyor 13. Similarly, the cutter motor 15 drives the cutting mechanism 16.

The ROM 6 stores programs for driving the thermal head 30 via the head driver circuit 9 in order to print the desired printing image on the printing medium M; the original data and size information of characters, symbols, pictographs, and the like included in the printing image to be printed; printing fonts; and the like. The ROM 6 also functions as a storage medium that stores programs that are readable by the processor 5.

The RAM 7 functions as an input data memory that stores printing information such as the characters, symbols, and pictographs included in the printing image to be printed as well as information that specifies the size, character spacing, and the like of those items; the size of the printed material to be created; and the like. The RAM 7 also functions as a printing data memory that stores printing data that represents the desired printing image and is created in accordance with the types of printing information described above that are input, as a display data memory that stores display pattern data that represents the desired printing image and is displayed on the display unit 4, or as the like. Moreover, the RAM 7 includes a register, counter, or the like for temporarily storing data needed for the printing process or the like.

The head driver circuit 9 controls the thermal head 30 in accordance with the printing data stored in the RAM 7. The thermal head 30 uses a thermal transfer process to print the desired printing image on the printing medium M in accordance with this control process.

The conveyor motor driver circuit 11 controls a step motor in accordance with the printing data stored in the RAM 7 in order to control the roller conveyor 13 and convey the printing medium M at a desired speed while the thermal head 30 is printing on the printing medium M.

The cutter motor driver circuit 14 controls the operation of the cutting mechanism 16. The cutting mechanism 16 cuts the printing medium M in a width direction that is orthogonal to the direction in which the printing medium M is conveyed in order to separate the created printed material from the printing medium M. Moreover, when the printing medium M has several layers (such as a base material, a release paper, and the like), the cutting mechanism 16 may cut just one of the layers (such as the base material) in the width direction.

The configuration of the printer 1 as described above is only an example and may be modified as appropriate as long as the configuration still includes a platen roller, the thermal head 30 (an example of a printing head that is supported by a supporting member), and a head moving mechanism that moves the thermal head 30.

Figure 4:
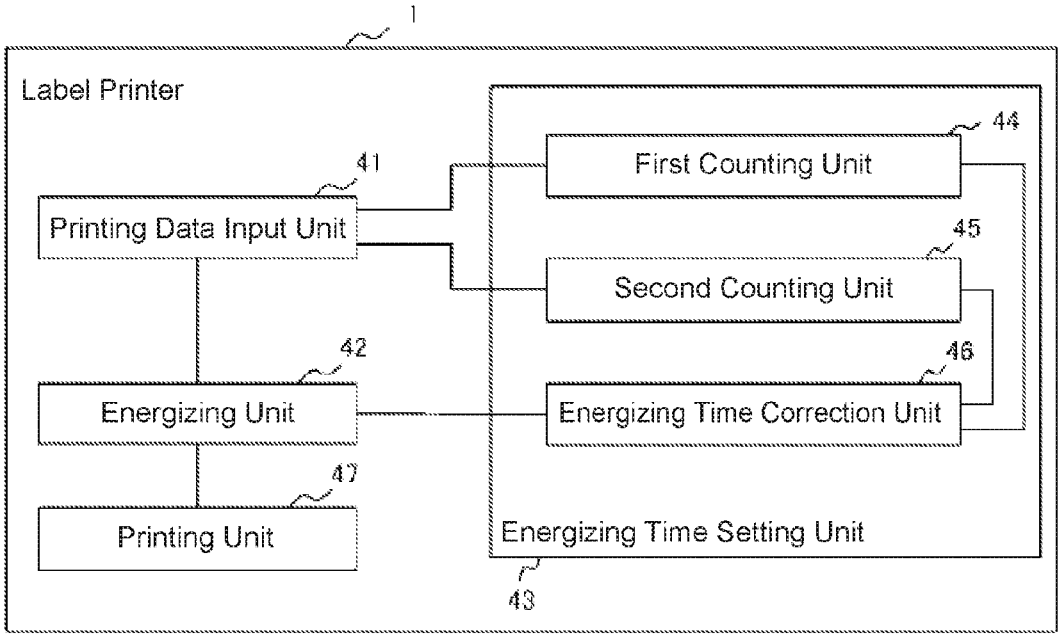
FIG. 4 is a functional block diagram of the printer according to the embodiment.

FIG. 4 is a functional block diagram of the printer according to the embodiment.

As illustrated in FIG. 4, the printer 1 includes a printing data input unit 41, an energizing unit 42, an energizing time setting unit 43, and a printing unit 47. Moreover, the energizing time setting unit 43 includes a first counting unit 44, a second counting unit 45, and an energizing time correction unit 46. Note that each of these functional blocks are implemented by the processor 5.

The printing data input unit 41 uses the input unit 3 described above to input printing data for printing on the printing medium M.

Figure 5:
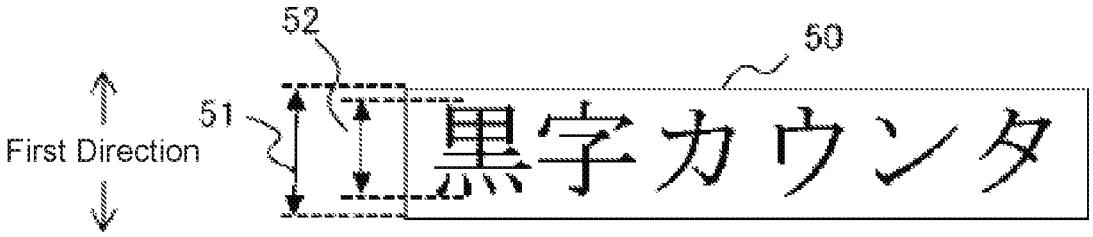
FIG. 5 illustrates an example of printing data.

In accordance with the line data representing a single line included in the printing data input from the printing data input unit 41, the energizing unit 42 selectively energizes a plurality of heating elements that are arranged on the thermal head 30 in a line that runs in a first direction of the printing medium M (such as the width direction of the elongated printing medium M, for example; see FIG. 5) for a prescribed energizing time in order to make the selected heating elements generate heat.

The energizing time setting unit 43 sets the energizing time, during which the selected heating elements of the plurality of heating elements are energized continuously, or intermittently by pulsed voltages or currents, in accordance with a ratio (number) of conduction dots and a distribution (distribution density) of conduction dots in the line of line data.

The first counting unit 44 of the energizing time setting unit 43 divides the line data representing a single line of the image into a plurality of groups so as to generate a plurality of line segments 81 and 82 (which are examples of "second line segments"), for example, as shown in FIG. 8. To estimate the number of a pair of successive conduction dots in each of the line segments, each of the line segments is further divided into a plurality of sub-segments—for example, further divided by half—to generate upper sub-segments 81*a* and 82*a*, and lower sub-segments 81*b* and 82*b*, respectively, as shown in FIG. 8. The first counting unit 44 then counts, the number of instances in which the two dots at the two adjacent ends of two adjacent sub-segments are both conduction dots, i.e., dots for which the corresponding heating elements are caused to emit heat to print the dots. In the example of FIG. 8, the first counting unit 44 determines whether the lowest dot in the upper sub-segment and the highest dot in the lower sub-segment are both conduction dots for each of the line segments 81, 82, etc., and counts the number of such an occurrence (in this case, either zero or one).

For example, let "black (B)" represent a conduction dot and "white (W)" represent a non-conduction dot (this notation will continue to be used below). If a particular line segment is 8-bit (1-byte) line data of BWBBBBWW, and if that partial line data is divided into two sub-segments, each of 4 bits in length, there would be the conduction dot B at the end of the first sub-segment BWBB and the conduction dot B at the beginning of the second sub-segment BBWW. Therefore, in this case, the number of the pair of the two consecutive conduction dots (black dots) would be counted as 1 instance. Similarly, if a particular line segment is a 16-bit (2-byte) line data of WWBBBWBBBBWWWWWW, and if this line segment is divided into four sub-segments each of 4 bits in length (WWBB, BWBB, BBWW, and WWWW), then the respective boundaries between the first and second, the second and third, and the third and fourth sub-segments are counted as 1, 1, and 0 instances, respectively, for the occurrence of a pair of successive conduction dots. Also note that the sub-segments are not limited to each being 4 bits in length and may instead each be 2 bits in length, for example.

Furthermore, the second counting unit 45 of the energizing time setting unit 43 divides each line data into a plurality of divided groups (which are examples of "first line segments"), each of several dots in length, and then counts the number of conduction dots in each divided group. For example, if the line data is BWBBBBWW, this data may be divided into two divided groups of BWBB and BBWW, and the number of black dots in these divided groups is counted as 3 and 2, respectively. The division of the line data into the plurality of divided groups, as defined and used by the second counting unit 45, may or may not be same as the division of the line data into the plurality of line segments or sub-segments, as defined and used by the first counting unit 44, as discussed above. In this embodiment, the divided groups, as defined and used by the second counting unit 45, is set to be the same as the sub-segments, as defined and used by the first counting unit 44, as discussed above (i.e., both are 4-bit dots).

For each line data representing a single line among the image data to be printed, the energizing time setting unit 43 sets the amount of time for which the energizing unit 42 passes current (i.e., the amount of time during which the printer head 30 generates heat; also referred to as "energizing time") according to the number of boundaries (i.e., pairs of successive conduction dots at the boundaries of sub-segments) counted by the first counting unit 44 and the number of conduction dots in the respective divided groups as counted by the second counting unit 45 for that line data. For example, when the first counting unit 44 counts a larger number of the boundaries (pairs) for a particular line data, the energizing time setting unit 43 sets a smaller value for the amount of time for which the energizing unit 42 passes current. Moreover, when the second counting unit 45 counts a larger number of divided groups that have zero number of conduction dots, the energizing time setting unit 43 sets a larger value for the energizing time, and when the second counting unit 45 counts a larger number of divided groups that have a non-zero number of conduction dots, the energizing time setting unit 43 sets a smaller value for the energizing time. For example, if a line data is BBBWWWWW, and if this line data is divided into BBBW and WWWW, then the number of counted boundaries (pairs of successive conduction dots at the boundary) is 0. Therefore, the energizing time would be set to a value larger than if the number of counted boundaries were 1, for example. Moreover, the number of black dots in these divided groups is 3 and 0, and therefore, the energizing time is set to a relatively larger value because there is a divided group having 0 black dots, and the energizing time is set to a relatively smaller value because there is a divided group having 3 black dots. Furthermore, the amount by which the energizing time is reduced because there is the divided group that has 3 black dots is greater than the amount by which the energizing time would be reduced when there is a divided group that has 2 black dots, for example. In another example, if there were two divided groups that each had 2 black dots, the amount by which the energizing time is to be reduced would be greater than the amount by which the energizing time would be reduced if there were only a single divided group that had 2 black dots.

Thus, in this embodiment, the energizing time correction unit 46 corrects the energizing time (i.e., the amount of time during which the energizing unit 42 drives the heating elements of the thermal head 30 continuously or intermittently by pulses) by a prescribed amount that is determined according to the number of boundaries counted by the first counting unit 44 and the number of conduction dots in the divided groups (or in other words, the number of divided groups that have respective numbers of conduction dots), as counted by the second counting unit 45. It is apparent that the number of boundaries (pairs) counted by the first counting unit 44 and the number of conduction dots in the divided groups (or in other words, the number of divided groups that have respective numbers of conduction dots), as counted by the second counting unit 45 are examples of information representing the distribution of conduction dots within the line data (i.e., distribution information of conduction dots).

Setting the energizing time in this way makes it possible to make the heating elements arranged on the thermal head 30 generate heat in a suitable manner. Moreover, generating heat in a suitable manner makes it possible to print with high quality.

The printing unit 47 activates the energizing unit 42 using the energizing time corrected by the energizing time correction unit 46 in order to transfer a dye on the ink ribbon R onto the printing medium M that is layered together with the ink ribbon R.

Figure 6:
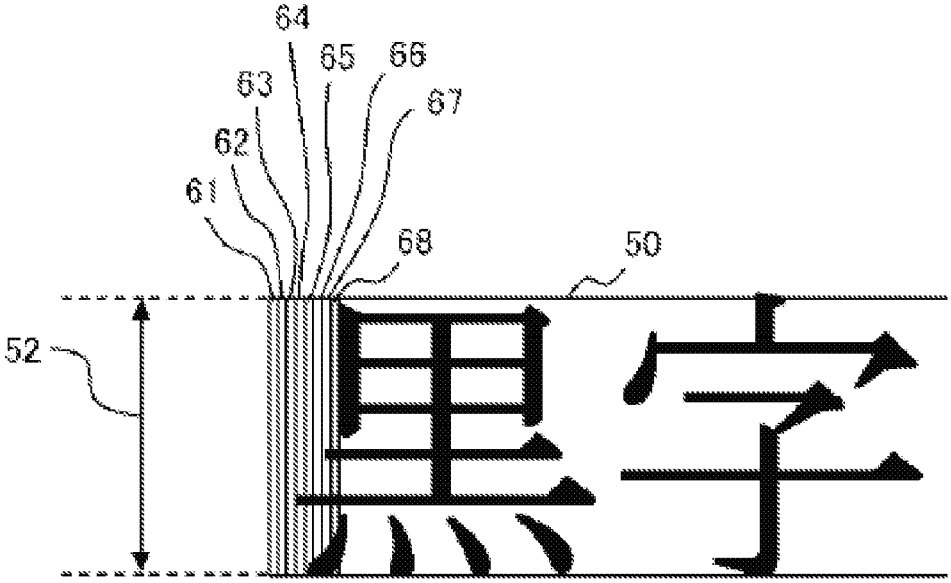
FIG. 6 is a drawing for explaining the concept of a line data.
Figure 7:
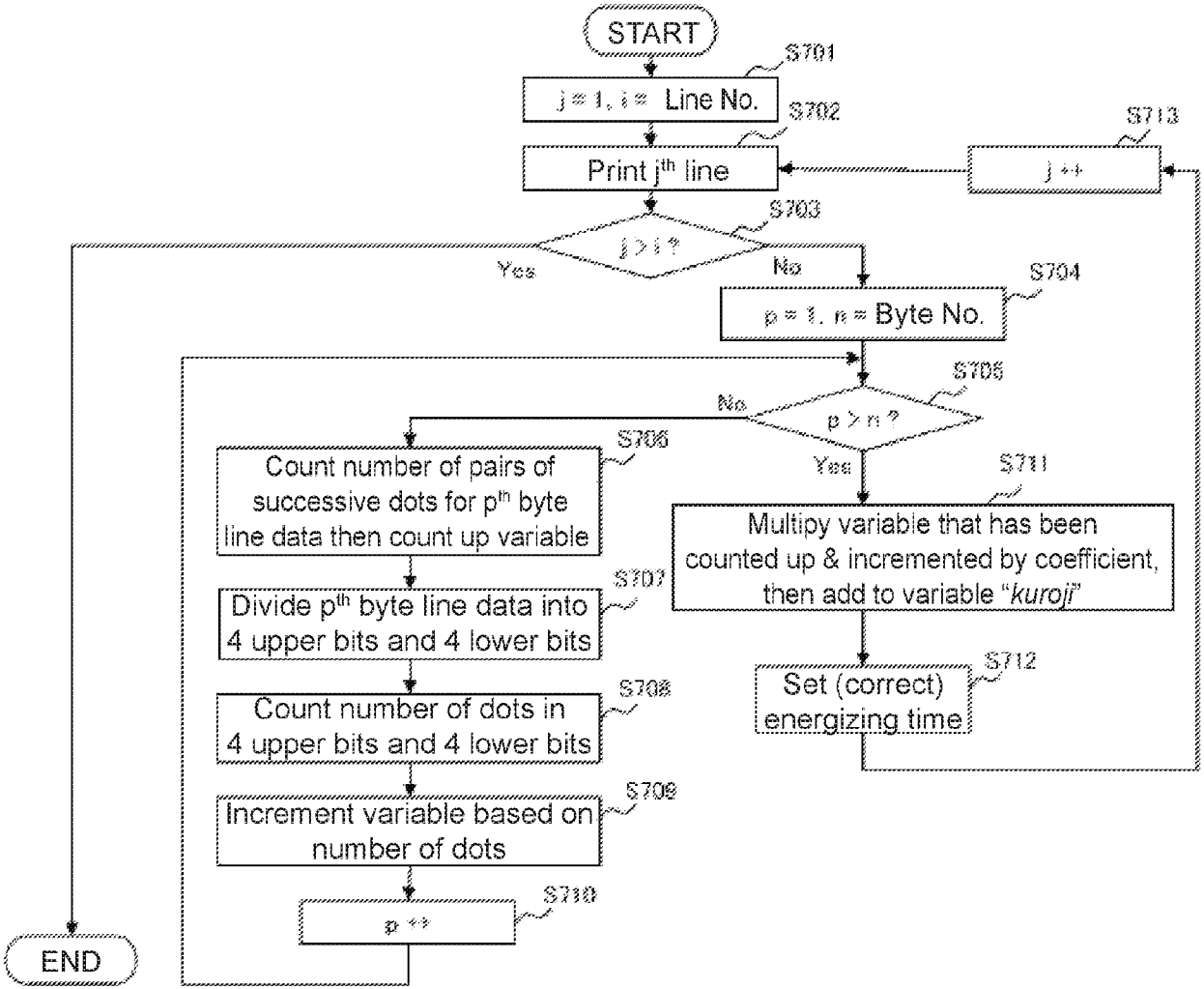
FIG. 7 is a flowchart of a printing process according to an embodiment.
Figure 11A:
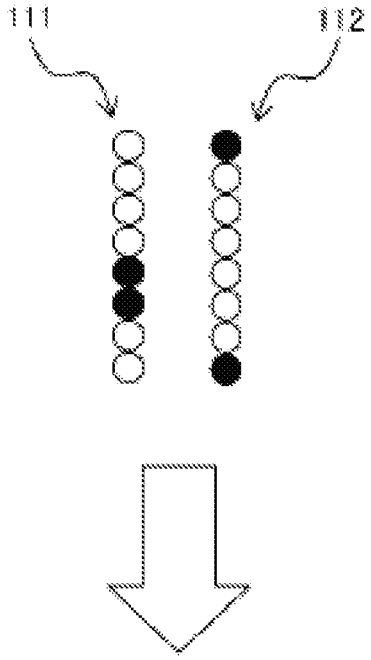
FIGS. 11A and 11B are drawings for explaining the reason for dividing up a line data.
Figure 11B:
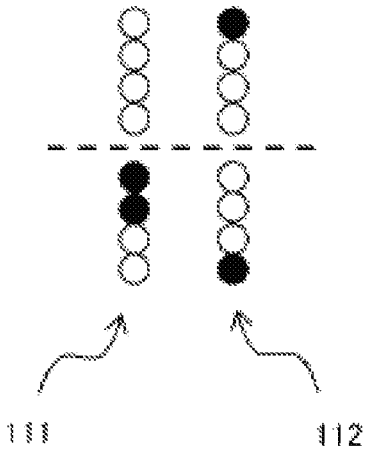

FIG. 5 illustrates an example of printing data. FIG. 6 is a drawing for explaining the concept of a line data. FIG. 7 is a flowchart of a printing process according to an embodiment. FIG. 8 illustrates an example of the structure of a line data showing a portion having two line segments that each have further divided sub-segments, as divided by the first counting unit 44. FIG. 9 illustrates an example of the structure of segments in the line data, as divided by the second counting unit 45. FIG. 10 illustrates the relationship between variables and coefficients. FIGS. 11A and 11B are drawings for explaining the reason for dividing up line data. Next, a printing process that is executed by the printer 1 described above will be described with reference to FIGS. 5 to 11 for an example in which the printing data includes i lines of line data. Note that the printing process described below is executed by the processor 5.

The printer 1 executes the printing process in order to print printing data 50 as illustrated in FIG. 5. In the example illustrated in FIG. 5, the printing data 50 is Japanese text for "Balance Counter," which is printed on an elongated tape (printing medium M) having a tape width 51 of approximately 18 mm. The region in which the printing data 50 is actually printed is within an effective printing width 52 of the tape, and here the effective printing width 52 is approximately 16 mm, for example.

As illustrated in FIG. 6, the printing data 50 includes a plurality of lines 61, 62, 63, 64, 65, 66, 67, 68, and so on. If the printer 1 has a printing resolution of 200 dpi, then each of the lines 61 and so on that are printed to fit in the effective printing width 52 of approximately 16 mm has a length of 128 bits. In other words, the lines 61 and so on can be represented as 128-bit addresses. For example, the lines can be represented as continuous 16-byte addresses in which each byte has 8 bits. The printing process executed by the printer 1 will be described using this data configuration as an example.

First, in step S701 of FIG. 7, the processor 5 of the printer 1 sets a variable j to 1 and sets the variable i to the total number of line data (i.e., the total number of lines) in the printing data 50. For example, if the printing data 50 includes 724 lines, the variable i is set to 724. Next, in step S702, the processor 5 prints the jth line. The first time through this loop, the processor 5 prints the 1st line. Then, in step S703, the processor 5 determines whether the value currently set to the variable j is greater than the value of the variable i (that is, whether j>i) in order to determine whether all of the printing data has been printed. This determination step continues to evaluate to No until steps S704 through S713 are repeated for all of the lines in the printing data 50.

Once it is determined that all of the printing data has been printed (Yes in step S703), the printing process ends.

Meanwhile, if it is determined that not all of the printing data has been printed yet (No in step S703), the processor 5 proceeds to step S704, sets a variable p to 1, and sets a variable n to the number of bytes in each line data. In this example, the variable n is set to 16. Next, in step S705, the processor 5 determines whether the value currently set to the variable p is greater than the value of the variable n (that is, whether p>n) in order to determine whether the processes in steps S706 to S710 (described below) have been executed for all of the bytes in the current line.

If it is determined that the value currently set to the variable p is not greater than the value of the variable n (No in step S704), the processor 5 executes the processes in steps S706 to S709 for each of the bytes that constitute the current line data. In other words, the processes in steps S706 to S709 are executed for each byte of the line data from the 1st byte to the nth byte (the 16th byte, for example).

First, in step S706, the processor 5 activates the first counting unit 44 in order to count the number of black dot boundaries (i.e., pairs of successive conduction dots) in the pth byte of the line data and then increments a variable "near" that has an initial value of 0 accordingly. For example, if the pth byte is a first line segment 81 of the line data 80 illustrated in FIG. 8, the line segment 81 is divided into the upper dot sub-segment (the first to the fourth dots) 81*a* and the lower dot sub-segment (the fifth to the eighth dots) 81*b*, and the number of black dot boundaries (pairs of successive conduction dots) is counted as 1 because the lowest bit of the upper sub-segment and the highest bit of the upper sub-segment are both black dots (conduction dots). As a result, the variable "near" is incremented. If the pth byte is a second line segment 82 of the line data 80 illustrated in FIG. 8, the line segment 82 is divided into the upper dot sub-segment (the ninth to the twelfth dots) 82*a* and the lower dot sub-segment (the thirteenth to the sixteenth dots) 82*b*, and at this time, the number of black dot boundaries (pairs of successive conduction dots) is counted as 0 because the lowest bit of the upper sub-segment and the highest bit of the upper sub-segment are both white dots (non-conduction dots). As a result, the variable "near" is not incremented (or in other words, would be incremented by 0). This way, when all the bytes are checked, the variable "near" represents the total number of the boundaries between the sub-segments that are bordered by two black dots across the boundary (i.e., pairs of successive conduction dots at the boundaries of the sub-segments).

Then, in step S707, the processor 5 divides the pth byte of the line data into an upper bit group and a lower bit group. In this example, each line includes 128 bits (16 bytes), with 8 bits per byte, and therefore, as illustrated in FIG. 9, the processor 5 divides the byte into a first divided group 91 that contains the upper 4 bits and a second divided group 92 that contains the lower 4 bits.

Next, in step S708, the processor 5 activates the second counting unit 45 in order to count the respective numbers of black dots in the first divided group 91 that contains the upper bits and in the second divided group 92 that contains the lower bits. In the example illustrated in FIG. 9, the first divided group 91 contains 2 black dots, and the second divided group 92 contains 3 black dots. The reason for dividing the line data in step S707 and then counting the respective numbers of black dots in each divided group is to be able to achieve a more detailed evaluation of the printing data, which is originally just a single massive set of line data. In the example of a line segment data 111 illustrated in FIG. 11A, for example, the black dots are near one another, while the black dots in a line segment data 112 are separated from one another. However, counting the total respective numbers of black dots in the line segment data 111 and the line segment data 112 yields the same result of 2 black dots for both data. Meanwhile, as illustrated in FIG. 11B, if the line segment data are divided into the upper 4 bit group and the lower 4 bit group, respectively, the numbers of black dots in the line segment data 111 are 0 and 2 in the respective groups, while the numbers of black dots in the line segment data 112 are 1 and 1 in the respective groups. In this example, the numbers of conduction dots in the line 111 and the line 112 are the same, but the distributions of those conduction dots are different.

Thus, by dividing the line data into a plurality of small dot groups, more detailed information on the distribution of the conduction dots can be obtained, enabling a more detailed evaluation of that data to be printed.

Next, in step 5709, the processor 5 increments (adds 1 to) various variables having initial values of 0 according to the values counted in step S708. For example, if a value of 0 was counted in step S708, a variable "zero" is incremented, while if value of 1 was counted, a variable "one" is incremented. Similarly, if values of 2, 3, or 4 are counted, the variables "two," "three," and "four" are incremented respectively. As noted above, initially, the values of these variables are all zero.

In step S710, the processor 5 increments the variable p, returns to step S705, and then repeats the processes in steps S706 and on for the next byte of the line data.

Once it is determined that the processes in steps S706 through S710 have been performed for all of the bytes that constitute the line data from step S704 (Yes in step S705), the processor 5 proceeds to step S711, multiplies the variable "near" counted in step S706 as well as the variables "zero," "one," "two," "three," and "four" incremented in step S709 by prescribed coefficients, and then adds up the results in a variable "kuroji." Examples of the multiplication coefficients are listed in FIG. 10. As shown in FIG. 10, the variable "near" is multiplied by a prescribed value selected from the range of 135 to 165 (such as 150), and then the result is added to the variable "kuroji." Similarly, the variables "zero," "one," "two," "three," and "four" are multiplied by any prescribed values selected from the respective ranges of −83 to −67, 68 to 84, 94 to 116, 355 to 435, and 418 to 512 (such as −75, 76, 105, 395, and 465), and then the results are added to the variable "kuroji" (which has an initial value of 0). The values of these coefficients can be prescribed empirically, for example, in accordance with a combination of various factors, such as the width of the tape used for printing, the printing speed, and the width of the thermal head 30, and are stored in ROM 6.

Next, in step S712, the processor 5 sets the energizing time using the thus obtained value of the variable "kuroji." For example, the value of the variable "kuroji" is subtracted from a prescribed energizing time value that was set in advance to generate the corrected energizing time.

Then, in step S713, the processor 5 increments the variable j, returns to step S702, and then repeats the processes in steps S702 and on for the next line of line data.

An embodiment of the present invention was described above with reference to figures. However, the printer to which the present invention is applied is not limited to the embodiment described above as long as that printer can perform the functions described above. For example, above, the first counting unit 44 counted the number of boundaries sandwiched by conduction dots, but alternatively the number of adjacencies among conduction dots in a line data may be counted. In this case, for a line data of WWBBBBWW, for example, the third and fourth, fourth and fifth, and fifth and sixth B dots (conduction dots) are adjacent to one another, and therefore the number of adjacencies would be 3. Moreover, when the data volume of each line data is large, the first counting unit 44 may divide the line data into a plurality of partial line segments as appropriate, count the number of conduction dot adjacencies within each partial line segment, and then also count the number of conduction dot adjacencies at the boundaries between adjacent partial line segments as well. For example, a line data of WWBBBWBBBBWWWWWW may be divided into two partial line segments: WWBBBWBB and BBWWWWWW. The numbers of adjacencies within the respective partial line segments are 3 and 1, and the last (eighth) B dot in the first partial line segment is adjacent to the initial (first) B dot in the second partial line segment (which counts as 1 additional adjacency). Thus, the total number of adjacencies would be 5 (=3+1+1).

Moreover, the energizing time setting unit 43 need not be equipped with both first counting unit 44 and second counting unit 45. For example, one of the first and second counting units 44 and 45 may be provided. Alternatively, the energizing time setting unit 43 may have both first counting unit 44 and second counting unit 45, but one of them can be activated at a time. When only the first counting unit 44 is provided or activated in the energizing time setting unit 43, the resulting value of the variable "near" is multiplied by a prescribed coefficient, and the result is added to the variable "kuroji." In this case, the only counted value of "near" affects the value of "kuroji," and thereby affects the correction of the energizing time. In this case, variables, "zero," "one," "two," "three," and "four," are not needed, or remain at the initial values of zero. When only the second counting unit 45 is provided or activated in the energizing time setting unit 43, the resulting values of the variables "zero," "one," "two," "three," and "four" are multiplied by prescribed respective coefficients, and the results are added to the variable "kuroji." In this case, the only counted values of "zero," "one," "two," "three," and "four" affect the value of "kuroji," and thereby affects the correction of the energizing time. In this case, variable, "near," is not needed, or remains at the initial value of zero.

Furthermore, in the embodiment of the present invention as described above, each function of the printer may be implemented with hardware, with digital signal processor (DSP) board or CPU board firmware, or with software. In addition, the printer to which the present invention is applied may be a single device, a system or integrated device that includes a plurality of devices, or a system that performs processes via a network such as a LAN or a WAN.

Moreover, the printer may also be implemented as a system that includes a CPU, ROM and RAM memory, an input device, an output device, an external storage device, a media driving device, and a network connection device that are all connected to a bus. In other words, ROM or RAM memory, an external storage device, or a portable storage medium that stores software programs for implementing the systems of the embodiment described above may be connected to the printer, and then a computer of the printer may read and execute those programs.

In this case, the programs themselves that are read from the portable storage medium or the like constitute a new feature of the present invention, and the portable storage medium or the like that stores those programs is included as part of the present invention.

Examples of portable storage media that can be used to supply programs include floppy disks, hard disks, optical disks, magneto-optical disks, CD-ROMs, CD-Rs, DVD-ROMs, DVD-RAMs, magnetic tape, non-volatile memory cards, ROM cards, various storage media on which data can be stored via network connection devices such as email and computer communications (that is, via communication lines), and the like.

Furthermore, in addition to a computer (an information processing device) executing programs loaded into memory in order to implement the functions of the embodiment described above, an OS or the like running on the computer may execute some or all of the actual processes according to instructions from those programs such that the functions of the embodiment described above are implemented by those processes.

In addition, programs read from a portable storage medium or programs (data) provided by a program (data) provider may be written to the memory of a function extension board inserted into the computer or a function extension unit connected to the computer, and then a CPU or the like of that function extension board or function extension unit may execute some or all of the actual processes according to instructions from those programs such that the functions of the embodiment described above are implemented by those processes.

In other words, the present invention is not limited to the embodiment described above, and various configurations and implementations are possible within the spirit of the present invention.

The present invention was described using the specific embodiment above as an example. However, the technical scope of the present invention is not limited to the embodiment described above. The scope of the present invention is not limited to the embodiment described above, and any configurations included in the scope of the claims and their equivalents are also encompassed by the present invention.

It is understood to persons skilled in the art that various modifications or improvements can be made to the specific embodiment described above, and such modifications and improvements are included within the technical scope of the present invention as defined by the claims.

What is claimed is:

1. A printer, comprising:

a printing head that includes a plurality of heating elements arranged in a first direction; and a processor, wherein printing data representing an image to be printed on a printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, wherein, for each of the line data, the processor selectively activates the heating elements that correspond to the printing dots in the line data so as to make the selected heating elements generate heat and print the corresponding printing dots in the line data on the printing medium, and wherein, for each of the line data, the processor obtains distribution information of the printing dots in the line data, and sets an energizing time, during which the selected heating elements are energized continuously, or intermittently by pulses, to print the corresponding printing dots, in accordance with the distribution information of the printing dots in the line data, wherein, in obtaining the distribution information of the printing dots for each of the line data, the processor counts or estimates an occurrence frequency of two successive printing dots in the line data, and wherein the processor sets said energizing time for each of the line data in accordance with the counted or estimated occurrence frequency of the two successive printing dots in the line data.

2. The printer according to claim 1, wherein, in obtaining the distribution information of the printing dots for each of the line data, the processor further divides the line data into a plurality of first line segments and counts a number of the printing dots in each of the plurality of the first line segments so as to obtain a distribution of the first line segments in terms of the numbers of the printing dots contained therein, and wherein the processor sets said energizing time for each of the line data in accordance with the counted or estimated occurrence frequency of the two successive printing dots in the line data and the obtained distribution of the first line segments in terms of the numbers of the printing dots therein.

3. The printer according to claim 2, wherein, in obtaining the distribution information of the printing dots for each of the line data, the processor divides the line data into a plurality of second line segments, which may be same as the plurality of first line segments, further divides each of the plurality of second line segments into a plurality of upper segments and lower segments, and counts a number of printing dot boundaries that are defined as boundaries between the upper segments and the lower segments that are sandwiched by two adjacent printing dots, so as to estimate the occurrence frequency of the two successive printing dots in the line data, and wherein the processor sets said energizing time for each of the line data in accordance with the counted number of the printing dot boundaries in the line data and the obtained distribution of the first line segments in terms of the numbers of the printing dots therein.

4. The printer according to claim 2, wherein the processor sets the energizing time for the selected heating elements in the line data to be relatively and correspondingly shorter when the number of the printing dots boundaries in the line data is relatively greater.

5. The printer according to claim 2, wherein the processor sets the energizing time for the selected heating elements in the line data to be relatively and correspondingly longer when a number of the first line segments for which the counted number of the printing dots is zero is relatively greater.

6. The printer according to claim 2, wherein the processor sets the energizing time for the selected heating elements in the line data to be relatively and correspondingly shorter when a number of the first line segments having a non-zero number of the printing dots is relatively greater.

7. The printer according to claim 2, wherein, in obtaining the distribution information of the printing dots for each of the line data, the processor counts the number of the two successive printing dots occurring in the line data, and wherein the processor sets said energizing time for each of the line data in accordance with the counted number of the two successive printing dots in the line data and the obtained distribution of the first line segments in terms of the numbers of the printing dots therein.

8. A method to be executed by a printer including a processor and a printing head that includes a plurality of heating elements arranged in a first direction, wherein printing data representing an image to be printed on a printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, the method comprising:

by way of the processor, for each of the line data, selectively activating the heating elements that correspond to the printing dots in the line data so as to make the selected heating elements generate heat and print the corresponding printing dots in the line data on the printing medium; and by way of the processor, for each of the line data, obtaining distribution information of the printing dots in the line data, and setting an energizing time during which the selected heating elements are energized continuously, or intermittently by pulses, to print the corresponding printing dots, in accordance with the distribution information of the printing dots in the line data, wherein the obtaining of the distribution information of the printing dots for each of the line data includes counting or estimating an occurrence frequency of two successive printing dots in the line data, and wherein said energizing time for each of the line data is set in accordance with the counted or estimated occurrence frequency of the two successive printing dots in the line data.

9. The method according to claim 8, wherein the obtaining of the distribution information of the printing dots for each of the line data further includes dividing the line data into a plurality of first line segments, and counting a number of the printing dots in each of the plurality of the first line segments so as to obtain a distribution of the first line segments in terms of the numbers of the printing dots contained therein, and wherein said energizing time for each of the line data is set in accordance with the counted or estimated occurrence frequency of the two successive printing dots in the line data and the obtained distribution of the first line segments in terms of the numbers of the printing dots therein.

10. The method according to claim 9, wherein the obtaining of the distribution information of the printing dots for each of the line data includes: dividing the line data into a plurality of second line segments, which may be same as the plurality of first line segments; further dividing each of the plurality of second line segments into a plurality of upper segments and lower segments; and counting a number of printing dot boundaries that are defined as boundaries between the upper segments and the lower segments that are sandwiched by two adjacent printing dots, so as to estimate the occurrence frequency of the two successive printing dots in the line data, and wherein said energizing time for each of the line data is set in accordance with the counted number of the printing dot boundaries in the line data and the obtained distribution of the first line segments in terms of the numbers of the printing dots therein.

11. The method according to claim 9, wherein the energizing time for the selected heating elements in the line data is set to be relatively and correspondingly shorter when the number of the printing dots boundaries in the line data is relatively greater.

12. The method according to claim 9, wherein the energizing time for the selected heating elements in the line data is set to be relatively and correspondingly longer when a number of the first line segments for which the counted number of the printing dots is zero is relatively greater.

13. The method according to claim 9, wherein the energizing time for the selected heating elements in the line data is set to be relatively and correspondingly shorter when a number of the first line segments having a non-zero number of the printing dots is relatively greater.

14. The method according to claim 9, wherein the obtaining of the distribution information of the printing dots for each of the line data includes counting the number of the two successive printing dots occurring in the line data, and wherein said energizing time for each of the line data is set in accordance with the counted number of the two successive printing dots in the line data and the obtained distribution of the first line segments in terms of the numbers of the printing dots therein.

15. A non-transitory computer-readable storage medium having stored therein a printing program executable by a printer that includes a processor and a printing head having a plurality of heating elements arranged in a first direction, wherein printing data representing an image to be printed on the printing medium are divided into a plurality of line data, each of the plurality of line data representing a corresponding line segment of the image, extending in the first direction, by a series of dots constituted of printing dots to be printed on the printing medium and non-printing dots that are not printed on the printing medium, the printing program causing the processor in the printer to perform the following:

for each of the line data, selectively activating the heating elements that correspond to the printing dots in the line data so as to make the selected heating elements generate heat and print the corresponding printing dots in the line data on the printing medium; and for each of the line data, obtaining distribution information of the printing dots in the line data; and setting an energizing time during which the selected heating elements are energized continuously, or intermittently by pulses, to print the corresponding printing dots, in accordance with the distribution information of the printing dots in the line data, wherein the obtaining of the distribution information of the printing dots for each of the line data includes counting or estimating an occurrence frequency of two successive printing dots in the line data, and wherein said energizing time for each of the line data is set in accordance with the counted or estimated occurrence frequency of the two successive printing dots in the line data.

16. The non-transitory computer-readable storage medium according to claim 15, wherein the obtaining of the distribution information of the printing dots for each of the line data further includes dividing the line data into a plurality of first line segments and counting a number of the printing dots in each of the plurality of the first line segments so as to obtain a distribution of the first line segments in terms of the numbers of the printing dots contained therein, and wherein said energizing time for each of the line data is set in accordance with the counted or estimated occurrence frequency of the two successive printing dots in the line data and the obtained distribution of the first line segments in terms of the numbers of the printing dots therein.

* * * * *